US010511900B2

(12) United States Patent
Yoneyama et al.

(10) Patent No.: US 10,511,900 B2
(45) Date of Patent: Dec. 17, 2019

(54) HEADPHONE

(71) Applicant: KABUSHIKI KAISHA AUDIO-TECHNICA, Tokyo (JP)

(72) Inventors: Daisuke Yoneyama, Tokyo (JP); Koji Otsuka, Tokyo (JP); Yumi Shimazaki, Tokyo (JP)

(73) Assignee: KABUSHIKI KAISHA AUDIO-TECHNICA, Tokyo (JP)

( * ) Notice: Subject to any disclaimer, the term of this patent is extended or adjusted under 35 U.S.C. 154(b) by 0 days.

(21) Appl. No.: 15/952,858

(22) Filed: Apr. 13, 2018

(65) Prior Publication Data

US 2018/0352318 A1 Dec. 6, 2018

(30) Foreign Application Priority Data

Jun. 5, 2017 (JP) ..... 2017-110726

(51) Int. Cl.
*H04R 1/10* (2006.01)
*H04R 1/28* (2006.01)

(52) U.S. Cl.
CPC ..... *H04R 1/1008* (2013.01); *H04R 1/288* (2013.01)

(58) Field of Classification Search
CPC .... H04R 1/288; H04R 1/1008; H04R 1/2819; H04R 1/2826
See application file for complete search history.

(56) References Cited

U.S. PATENT DOCUMENTS 4,211,898 A * 7/1980 Atoji ..... H04R 1/225 381/349
4,742,887 A * 5/1988 Yamagishi ..... H04R 1/2857 181/129
9,591,398 B1 3/2017 Wang

FOREIGN PATENT DOCUMENTS

EP 0873040 A2 4/1998
JP 2009-033768 A 2/2009

OTHER PUBLICATIONS

European Search Report, 18165842.8, Audio-Technica Corporation, dated Oct. 12, 2018.
Examination Report issued in counterpart European application No. 18 165 842.8-1210; dated May 22, 2019.
Examination Report issued in counterpart Japanese application No. 18 165 842.8-1210; dated May 22, 2019.

* cited by examiner

*Primary Examiner* — Brian Ensey
(74) *Attorney, Agent, or Firm* — W&C IP

(57) ABSTRACT

A headphone includes a driver unit 2, the first housing 4 that forms a first air chamber 11 on a back side of the driver unit 2, the second housing 5 that forms a second air chamber 12 on an opposite side of an inner surface different from an inner surface where the driver unit 2 is provided in the first housing 4, and a damper 61 provided in the second housing 5. In the first housing 4, an opening 44 that communicates between the first air chamber 11 and the second air chamber 12 is formed.

7 Claims, 10 Drawing Sheets

600

610

620

HEADPHONE

CROSS-REFERENCE TO RELATED APPLICATIONS

The present application claims priority to Japanese Patent Application number 2017-110726, filed on Jun. 5, 2017. The contents of this application are incorporated herein by reference in their entirety.

TECHNICAL FIELD

The present invention relates to a headphone.

BACKGROUND ART

Conventionally, a technique to adjust acoustic characteristics of a headphone by forming an opening in a housing of the headphone is known. Japanese Unexamined Patent Application Publication No. 2009-033768 discloses a technique that improves acoustic characteristics by providing a housing with a port having (i) a through hole closed with an acoustic resistance material for communicating between a rear cavity of a headphone and the outside and (ii) acoustic mass.

In the conventional technique, acoustic characteristics can be adjusted by adjusting the diameter and the length of the port. However, there were problems that adjusting acoustic characteristics by changing the diameter and the length of the port required many man-hours and that finely adjusting acoustic characteristics was difficult.

BRIEF SUMMARY OF THE INVENTION

This invention focuses on these points, and an object of the invention is to provide a headphone having configurations suitable for fine adjustments of acoustic characteristics.

A headphone according to the present invention includes a driver unit, the first housing that forms the first air chamber on a back side of the driver unit, the second housing that forms the second air chamber on an opposite side of an inner surface different from an inner surface on the driver unit side in the first housing, the first communication means that communicates between the first air chamber and the second air chamber, and the second communication means that communicates between the second air chamber and the outside, wherein the first communication means and the second communication means include at least one of an acoustic resistance material and an opening.

DETAILED DESCRIPTION OF THE INVENTION

Hereinafter, the present invention will be described through exemplary embodiments of the present invention, but the following exemplary embodiments do not limit the invention according to the claims, and not all of the combinations of features described in the exemplary embodiments are necessarily essential to the solution means of the invention.

(Outline of the Present Exemplary Embodiments)

Hereinafter, ear cups of various headphones according to the present exemplary embodiment are explained with examples. An ear cup according to the present exemplary embodiment includes the first housing forming the first air chamber, the second housing forming the second air chamber, the first communication means for communicating between the first air chamber and the second air chamber, the second communication means for communicating between the second air chamber and the outside. The first communication means and the second communication means include at least one of an acoustic resistance material and an opening. By having the above-mentioned configurations, the ear cup is configured to have the first housing, the second housing, and the acoustic resistance material and acoustic mass that are provided in series in an equivalent mechanical acoustic circuit. As a result, a fine adjustment of acoustic characteristics is enabled by changing the number of openings or the size of openings formed as the acoustic mass in the housing or by changing the number of openings or the size of openings formed in the acoustic resistance material.

First Example

Figure 1:
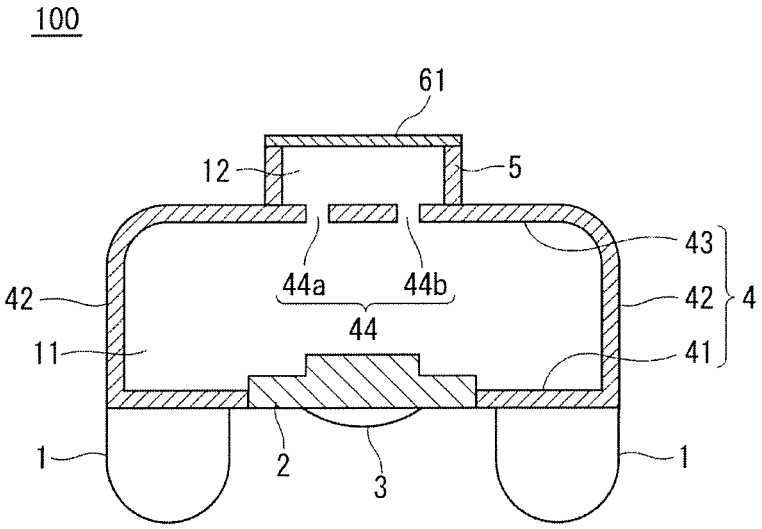
FIG. 1 schematically shows a cross section of an ear cup (the first example) according to the exemplary embodiment.
Figure 2:
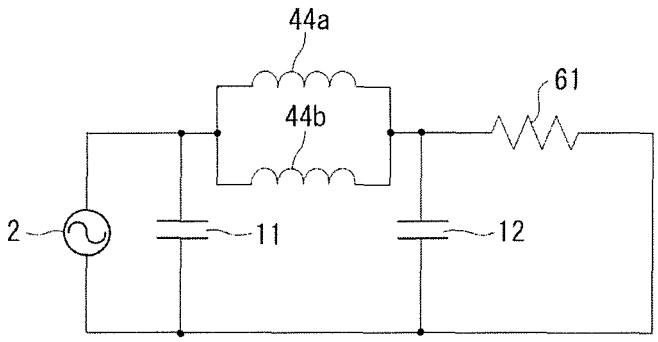
FIG. 2 shows a mechanical acoustic circuit of the ear cup (the first example) according to the exemplary embodiment.

FIG. 1 is a schematic cross-sectional view of an ear cup 100 according to the present exemplary embodiment. FIG. 2 shows a mechanical acoustic circuit of the ear cup 100.

The ear cup 100 includes an ear pad 1, a driver unit 2, a diaphragm (sound emitting part) 3, the first housing 4, the second housing 5, and a damper 61. The ear pad 1 is a pad that contacts an area around a user's ear.

The first housing 4 is a member forming the first air chamber 11 on the back side of the driver unit 2. The first housing 4 is made of a resin, for example. The first housing 4 forms the first air chamber 11 with the first plate part 41, the second plate part 42, and the third plate part 43. The first plate part 41 on the driver unit 2 side is a round plate member and functions as a baffle board. The driver unit 2 is inserted near the center of the first plate part 41. The second plate part 42 is a ring-shaped plate member extending in a direction orthogonal to the first plate part 41. The third plate part 43 is a round plate member facing the first plate part 41. The first housing 4 may be integrally molded, or may be formed by joining the first plate part 41, the second plate part 42, and the third plate part 43 which are individually molded.

The second housing 5 is a member forming the second air chamber 12 on the opposite side of an inner surface different from an inner surface where the driver unit 2 is provided.

The inner surface different from the inner surface where the driver unit 2 is provided is, for example, an inner surface of the second plate part 42 or the third plate part 43, but not of the first plate part 41. In FIG. 1, the second housing 5 is provided to form the second air chamber 12 at a position opposite the inner surface of the third plate part 43, which is an inner surface parallel to the inner surface where the driver unit 2 is provided. The second housing 5 may be in any shape, and the second housing 5 is configured with a ring-shaped plate in the example of FIG. 1. The diameter of the second housing 5 is, for example, less than or equal to the diameter of the first housing 4. In this case, the volume of the second air chamber 12 is less than the volume of the first air chamber 11.

The damper 61 is a flexible mesh member, for example, and functions as the first acoustic resistance material, which is the second communication means for communicating between the second air chamber 12 and the outside. The communication means connects the two spaces through impedance greater than or equal to zero, such as an acoustic mass, acoustic resistance material, or the like. The damper 61 is fixed to an end of the side that does not contact the third plate part 43 of the second housing 5. The damper 61 is fixed to an end of an opening of the second housing 5 with, for example, an adhesive or double-sided tape.

In the first housing 4, openings 44 (44*a*, 44*b*), which are the first openings, are formed as the first communication means that communicates between the first air chamber 11 and the second air chamber 12. The openings 44 function as the acoustic mass. The shape of the openings 44 is circular, for example, but the openings 44 may be in any shape.

In the ear cup 100, with the above-mentioned configuration, the openings 44*a* and 44*b* functioning as the acoustic mass and the damper 61 functioning as the acoustic resistance material are acoustically connected in series between the driver unit 2 and the outside, as illustrated in the mechanical acoustic circuit (acoustic equivalent circuit) in FIG. 2. Also, the first air chamber 11 and the second air chamber 12 both having an acoustic stiffness are connected in parallel. The ear cup 100 configured in such a manner makes it easier to adjust acoustic characteristics.

For example, changing the number of openings 44, changing the inner diameter of the openings 44, or changing the size or the thickness of the damper 61 enables an adjustment or a fine adjustment of the acoustic characteristics in a designing stage. Furthermore, changing the volume of either one of the first air chamber 11 or the second air chamber 12 enables an adjustment or a fine adjustment of the acoustic characteristics. Because the ear cup 100 has the above-mentioned configuration suitable for such a fine adjustment, headphones with less individual variability and with good acoustic characteristics can be provided.

It should be noted that, in FIG. 1, the damper 61 is exposed to the outside but the ear cup 100 may also include a housing which covers at least a portion of the damper 61 and the third plate part 43.

Second Example

Figure 3:
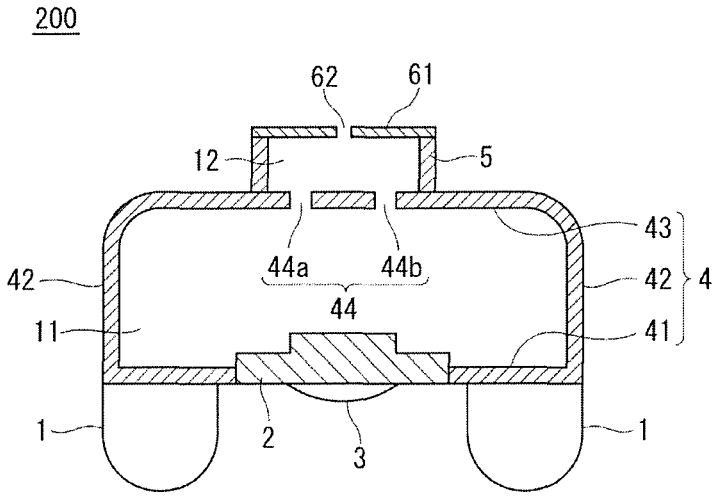
FIG. 3 schematically shows a cross section of an ear cup (the second example) according to the exemplary embodiment.

FIG. 3 is a schematic cross-sectional view of an ear cup 200 as a second example of the present exemplary embodiment. The ear cup 200 is different from the ear cup 100 shown in FIG. 1 in that an opening 62 that serves as the second opening functioning as the acoustic mass is formed in the damper 61, and the ear cup 200 is otherwise the same as the ear cup 100. The opening 62 is formed, for example, near the center of the damper 61. The shape of the opening 62 is circular, for example, but the opening 62 may be in any shape.

When the opening 62 is formed in the damper 61, the damper 61 functioning as the acoustic resistance material and the opening 62 functioning as the acoustic mass are connected with one another in parallel in the mechanical acoustic circuit. Having the opening 62 formed on the damper 61, the ear cup 200 enables a fine adjustment of acoustic characteristics by changing the number of the openings 62 or by changing the inner diameter of the opening 62, and the degree of freedom for adjusting the acoustic characteristics is further enhanced.

Third Example

Figure 4:
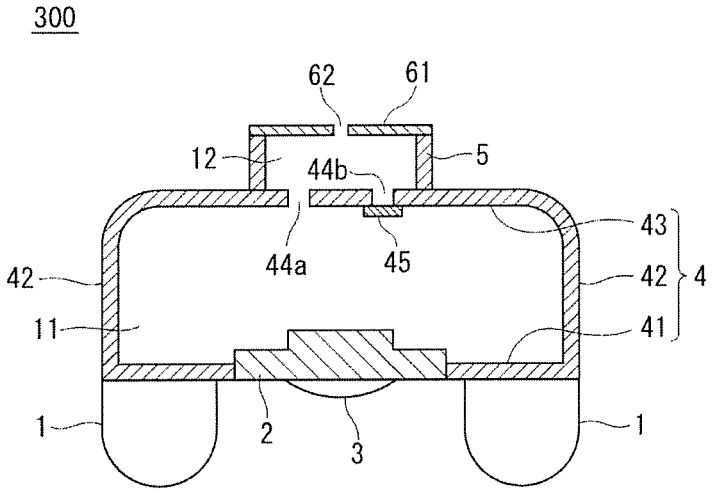
FIG. 4 schematically shows a cross section of an ear cup (the third example) according to the exemplary embodiment.

FIG. 4 is a schematic cross-sectional view of an ear cup 300 as a third example of the present exemplary embodiment. The ear cup 300 is different from the ear cup 200 shown in FIG. 3 in that a damper 45 functioning as the acoustic resistance material is provided to cover an opening 44*b* which is one of the openings 44, and the ear cup 300 is otherwise the same as the ear cup 200. The damper 45 is provided at a position where the opening 44*b* is covered on the first air chamber 11 side. The damper 45 may be provided on the second air chamber 12 side.

By having the damper 45 which covers at least one opening among the openings 44, the damper 45 serving as the acoustic resistance material, the opening 44*b* serving as the acoustic mass, the damper 61 functioning as the acoustic resistance material, and the opening 62 functioning as the acoustic mass are connected in series in the mechanical acoustic circuit. As a result, changing the thickness of the damper 45 or changing the number of the openings 44 provided with the damper 45 enables a fine adjustment of acoustic characteristics and the degree of freedom for adjusting acoustic characteristics is further enhanced. It should be noted that, when the damper 45 covers the opening 44*b*, the damper 45 may cover a portion of the opening 44*b*. By enabling an adjustment of the area of the opening 44*b* to be covered with the damper 45, the degree of freedom of adjusting acoustic characteristics is further enhanced.

Fourth Example

Figure 5A:
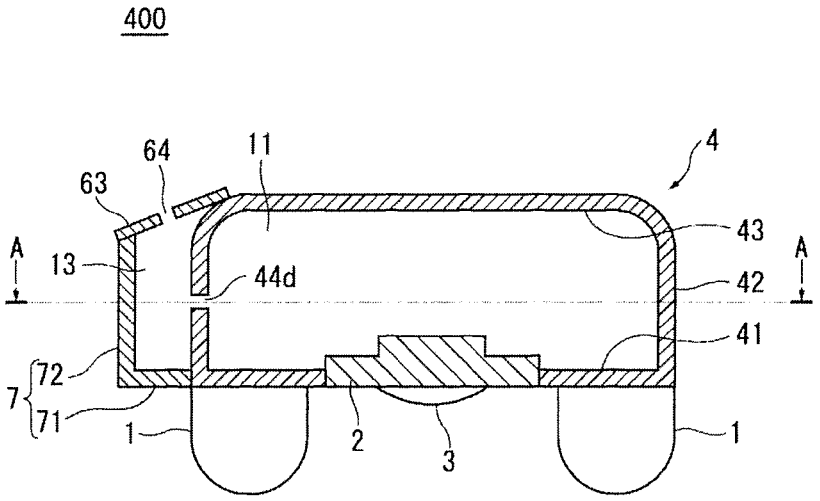
FIGS. 5A and 5B each schematically show a cross section of an ear cup (the fourth example) according to the exemplary embodiment.
Figure 5B:
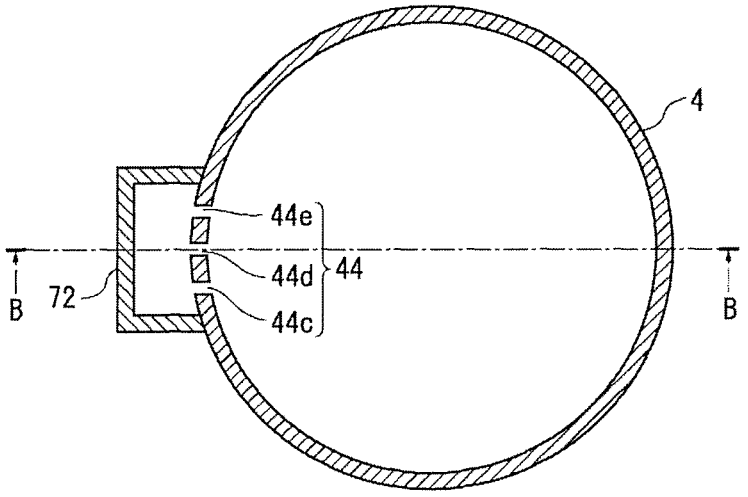

FIGS. 5A and 5B are schematic sectional views of an ear cup 400 as a fourth example of the present exemplary embodiment. FIG. 5A is a cross-sectional view (a B-B line cross-sectional view) of the ear cup 400 in a direction in which the first air chamber 11 and the second air chamber 13 are lined up. FIG. 5B is a cross-sectional view (an A-A line cross-sectional view) of the ear cup 400 in a longitudinal direction of the first air chamber 11.

The ear cup 400 is different from the ear cup 200 shown in FIG. 3 in that the second housing 7 forming the second air chamber 13 is provided on an opposite side of an inner surface orthogonal to an inner surface where the driver unit 2 is provided in the first housing 4. Specifically, in the ear cup 400, the second housing 7 forming the second air chamber 13 is provided on the opposite side of an inner surface of the second plate part 42 orthogonal to the first plate part 41. In the second plate part 42, the openings 44*c*, 44*d*, and 44*d* that communicate between the first air chamber 11 and the second air chamber 13 are provided.

The second housing 7 includes a horizontal plate part 71 in a direction of the surface of the first plate part 41 and a vertical plate part 72 in a direction orthogonal to the horizontal plate part 71. The height of the second housing 7, in the direction orthogonal to the inner surface where the driver unit 2 is provided, is less than the height of the first housing 4. In the example shown in FIG. 5A, the height of the vertical plate part 72 is less than the height of the second plate part 42. Also, the height of the second housing 7, in the direction orthogonal to the inner surface where the driver unit 2 is provided, becomes lesser toward the outside, and the second housing 7 includes an inclined plane provided with an acoustic resistance material having an opening. Specifically, the damper 63 functioning as the acoustic resistance material is provided such that the damper 63 is inclined between the vertical plate part 72 and the third plate part 43. In the damper 63, an opening 64 that serves as the second opening functioning as the acoustic mass is formed.

Because the second air chamber 13 is provided at a position adjacent to the first air chamber 11 in the longitudinal direction of the first air chamber 11 in such a manner, the thickness of the ear cup 400 can be reduced. Also, because the upper side (the side away from the ear when worn) of the second air chamber 13 is inclined, the thickness of the ear cup 400 becomes gradually smaller in a direction toward the vertical plate part 72 from the second plate part 42, which enhances design. It should be noted that an opening 64 is formed in the second housing 7 shown in FIGS. 5A and 5B, but an opening does not need be formed in the second housing 7.

It should be noted that in the above explanation, the configuration of the first housing 4 formed with two openings 44 is illustrated, but the first housing 4 may also be formed with one opening 44. The first housing 4 may also be formed with three or more openings 44. Similarly, any number of openings may be formed in the dampers 61 and 63.

Fifth Example

Figure 6:
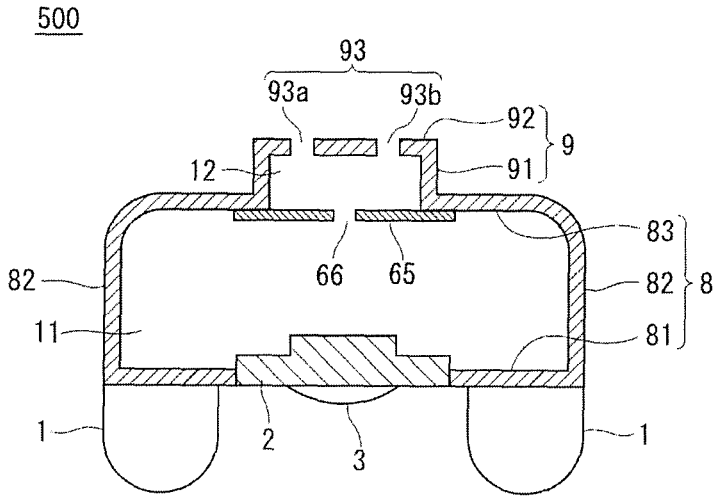
FIG. 6 schematically shows a cross section of an ear cup according to the exemplary embodiment.

FIG. 6 is a schematic cross-sectional view of an ear cup 500 as a fifth example of the present exemplary embodiment. The ear cup 500 includes the ear pad 1, the driver unit 2, the diaphragm 3, the first housing 8, the second housing 9, and a damper 65.

The ear pad 1, the driver unit 2, and the diaphragm 3 are the same as the ear pad 1, the driver unit 2, and the diaphragm 3 of the ear cup 100. The first housing 8 corresponds to the first housing 4 of the ear cup 100 and forms the first air chamber 11. The first plate part 81 is the same as the first plate part 41. The second plate 82 is the same as the second plate part 42. However, the third plate part 83 is different from the third plate part 43 of the ear cup 100 in that the third plate part 83 does not form the boundary between the first air chamber 11 and the second air chamber 12.

The second housing 9 corresponds to the second housing 5 of the ear cup 100 and forms the second air chamber 12. The second housing 9 includes an annular part 91 and an outer part 92. The annular part 91 has a shape equivalent to that of the second housing 5, and one end of the annular part 91 is connected to the third plate part 83. The outer part 92 is provided at the other end of the annular part 91, and openings 93 (93*a*, 93*b*), which are fourth openings functioning as the acoustic mass, are formed in the outer part 92.

The damper 65 is fixed with an adhesive or double-sided tape to the surface on the first air chamber 11 side in the third plate part 83 at the boundary position of the first air chamber 11 and the second air chamber 12. In the damper 65, an opening 66, which is a third opening, is formed. Because the ear cup 500 has the above-mentioned configuration, the damper 65 functioning as the acoustic resistance material and the openings 93 functioning as the acoustic mass are connected in series in the mechanical acoustic circuit between the driver unit 2 and the outside.

Because the ear cup 500 has the first air chamber 11 and the second air chamber 12, and the acoustic resistance material and the acoustic mass are connected in series in the mechanical acoustic circuit in such a manner, adjusting the acoustic characteristics becomes easier. For example, changing the number of the openings 93, changing the inner diameter of the openings 93, and changing the thickness or the size of the damper 65 enables a fine adjustment of the acoustic characteristics in a designing stage.

Effect of Headphone According to the Exemplary Embodiments

As described above, the ear cups 100 to 500 according to the exemplary embodiments include the first housing 4 or the first housing 8 that forms the first air chamber 11, the second housing 5 or the second housing 9 that forms the second air chamber 12, and the acoustic resistance material and the acoustic mass that are provided in series in the equivalent mechanical acoustic circuit. The ear cups 100 to 500 according to the exemplary embodiments having the above-mentioned configuration enable a fine adjustment of acoustic characteristics by changing the number and the size of the openings functioning as the acoustic mass formed in the housing as well as by changing the number and the size of the openings formed in the acoustic resistance material.

Result of Comparative Experiment

Figure 7A:
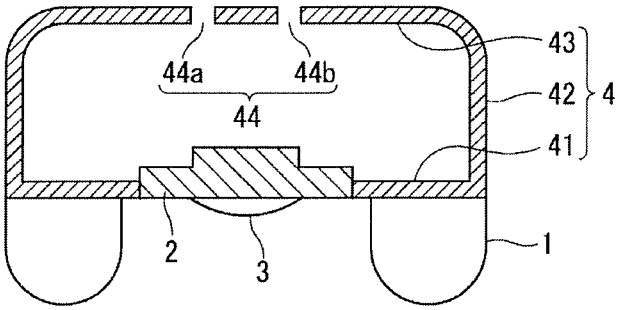
FIGS. 7A to 7C each schematically show a cross section of a conventional ear cup used in a comparative experiment to verify an effect of the headphone.
Figure 7B:
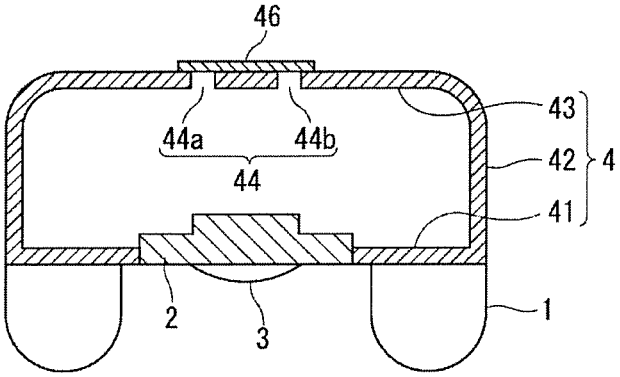
Figure 7C:
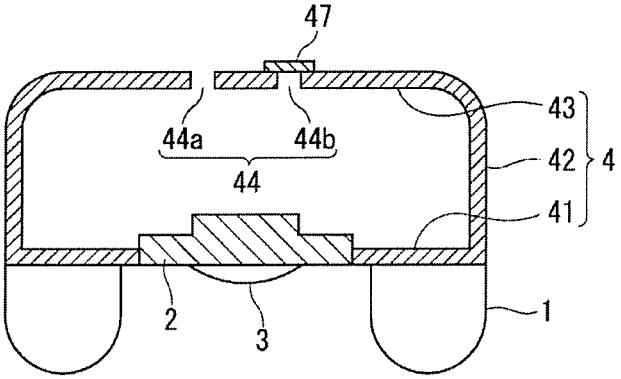

FIGS. 7A, 7B, and 7C are schematic cross-sectional views of a conventional ear cup used in a comparative experiment to verify the effect of the headphones according to the exemplary embodiments. FIG. 7A is a cross-sectional view of the ear cup 600 in a state where the second housing 5 and the damper 61 are removed from the ear cup 100 shown in FIG. 1. FIG. 7B is a cross-sectional view of the ear cup 610 in which the damper 46 is provided to cover the openings 44 of the ear cup 600. FIG. 7C is a cross-sectional view of the ear cup 620 in which the damper 47 is provided at the outside of the opening 44*b*.

Figure 8:
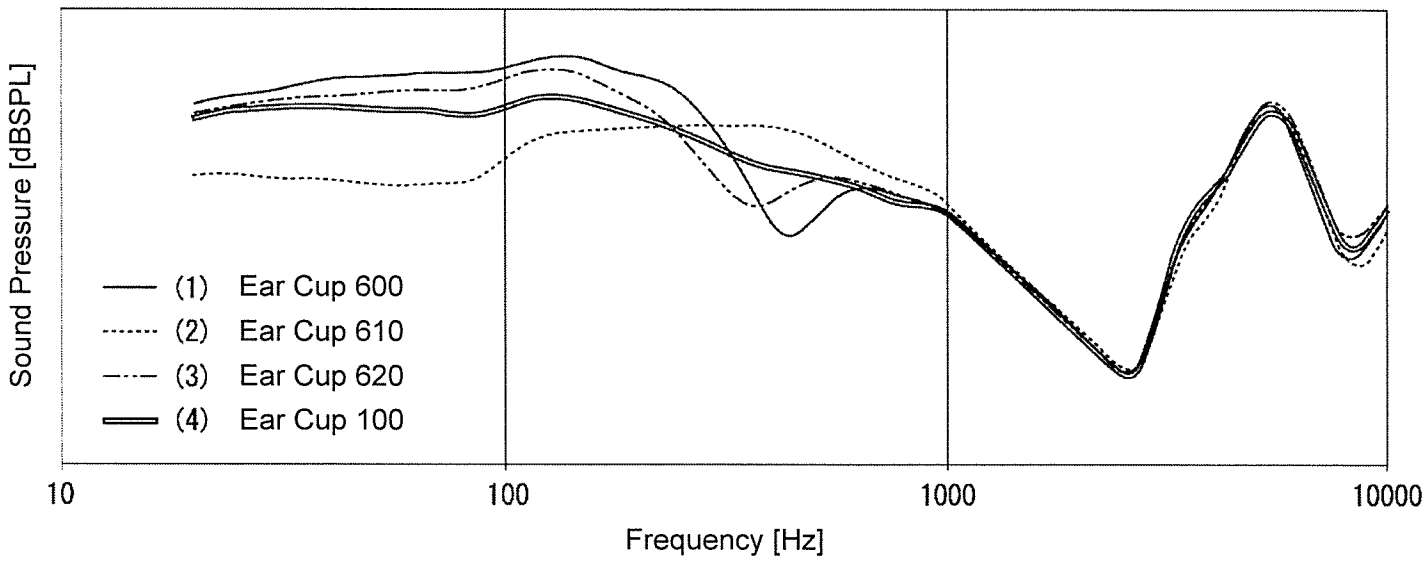
FIG. 8 shows acoustic characteristics of an ear cup.

FIG. 8 shows acoustic characteristics of the ear cups 100, 600, 610, and 620. The horizontal axis of FIG. 8 indicates the frequency and the vertical axis indicates the sound pressure. The solid line indicates acoustic characteristics of the ear cup 600, the broken line indicates acoustic characteristics of the ear cup 610, the two-dot chain line indicates acoustic characteristics of the ear cup 620, and the double lines indicate acoustic characteristics of the ear cup 100.

As the solid line in FIG. 8 indicates, in acoustic characteristics of the ear cup 600 in which the first housing 4 is provided only with openings 44, a large drop in the sound pressure is observed between 100 Hz and 1000 Hz. Also, as the broken line in FIG. 8 indicates, with the ear cup 610 in which the damper 46 is provided to cover the openings 44, a large drop in the sound pressure is not observed between 100 Hz and 1000 Hz, but a large drop in the sound pressure of the low frequency equal to or below 100 Hz is observed. As the two-dot chain line in FIG. 8 indicates, with the ear cup 620 in which the damper 47 is provided to cover the opening 44*b*, the variation amount of sound pressure is smaller compared to the ear cup 600, but a large drop in the sound pressure is observed between 100 Hz and 1000 Hz.

In contrast, in acoustic characteristics of the ear cup 400, a large drop in the sound pressure is not observed in the frequency equal to or below 1000 Hz, and the sound pressure equal to or below 100 Hz is maintained at the same level as with the ear cups 600 and 620. As such, it was verified that the headphone according to the present exemplary embodiment is suitable for the improvement of acoustic characteristics.

Exemplary Design

Figure 9:
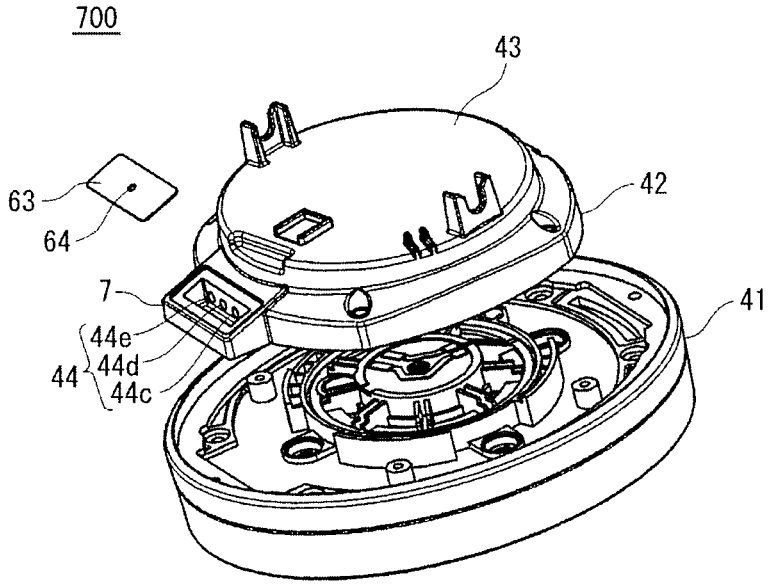
FIG. 9 is a perspective view of a disassembled ear cup.
Figure 10A:
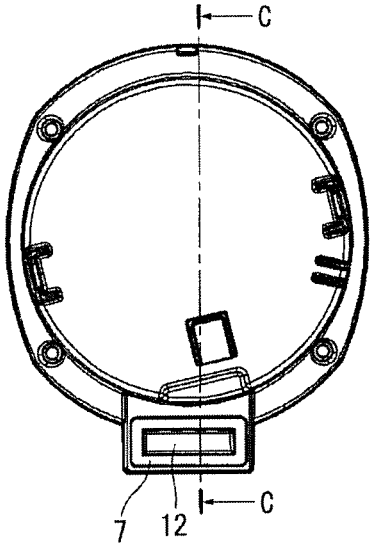
FIG. 10A is a cross-sectional view of an ear cup.
Figure 10B:
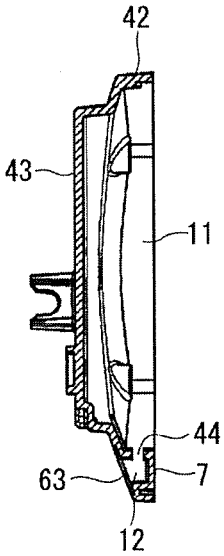
FIG. 10B is a cross-sectional view of the ear cup.

FIG. 9, as well as FIGS. 10A and 10B, shows the configuration of an ear cup 700 according to the embodiment corresponding to the ear cup 400 shown in FIGS. 5A and 5B. FIG. 9 is a perspective view of the ear cup 700 in a disassembled state. FIGS. 10A and 10B each is a cross-sectional view of the ear cup 700. FIG. 10A is a top side view of the assembled ear cup 700 from which the damper 63 is removed.

FIG. 10B is a C-C line cross-sectional view of FIG. 10A.

As shown in FIGS. 10A and 10B, in the ear cup 700, because the second air chamber 12 is provided adjacent to the first air chamber 11 in the longitudinal direction of the first air chamber 11, the thickness of the ear cup 700 is not increased due to the second housing 7 being provided. It should be noted that, since the damper 63 that is inclined along the longitudinal direction of the first air chamber 11 is provided in the second housing 7, the increase of the volume of the ear cup 700 due to having the second housing 7 is minimized in the ear cup 700. Thus, the ear cup 700 is capable of providing a headphone having a design that would have been difficult to achieve if the conventional port were used.

The present invention is explained on the basis of the exemplary embodiments. The technical scope of the present invention is not limited to the scope explained in the above embodiments and it is possible to make various changes and modifications within the scope of the invention. For example, the specific embodiments of the distribution and integration of the apparatus are not limited to the above embodiments, all or part thereof, can be configured with any unit which is functionally or physically dispersed or integrated. Further, new exemplary embodiments generated by arbitrary combinations of them are included in the exemplary embodiments of the present invention. Further, effects of the new exemplary embodiments brought by the combinations also have the effects of the original exemplary embodiments.

What is claimed is:

1. A headphone comprising:

a driver unit;

a first housing that forms a first air chamber on a back side of the driver unit;

a second housing that forms a second air chamber on an opposite side of an inner surface different from an inner surface where the driver unit is provided in the first housing;

a first communication means that communicates between the first air chamber and the second air chamber; and a second communication means that communicates between the second air chamber and an outside, wherein the first communication means and the second communication means include at least one of an acoustic resistance material and an opening, the second housing is provided on an opposite side of an inner surface of the first housing, the inner surface being orthogonal to the inner surface where the driver unit is provided, the height of the second housing, in the direction orthogonal to the inner surface where the driver unit is provided, is less than the height of the first housing and becomes lesser toward the outside, and the second housing includes the second communicating means having an inclined plane provided with an acoustic resistance material having an opening.

2. The headphone according to claim 1, wherein the first communication means is a first opening formed in the first housing, and the second communication means is a first acoustic resistance material formed in the second housing.

3. The headphone according to claim 2, wherein the first opening and the first acoustic resistance material are acoustically connected in series.

4. The headphone according to claim 2, wherein the first housing has a plurality of the first openings.

5. The headphone according to claim 4, further comprising a second acoustic resistance material provided to cover at least a first opening among the plurality of first openings.

6. The headphone according to claim 2, wherein a second opening is formed in series with the first opening.

7. The headphone according to claim 1, wherein a volume of the second air chamber is less than a volume of the first air chamber.

* * * * *